US006146141A

United States Patent [19]

Schumann

[11] Patent Number: 6,146,141

[45] Date of Patent: Nov. 14, 2000

[54] LASER PISTOL

[76] Inventor: Edgar Schumann, Flerrentwiete 38, Hamburg, D-22559, Germany

[21] Appl. No.: 09/269,905

[22] PCT Filed: Oct. 2, 1997

[86] PCT No.: PCT/EP97/05439

§ 371 Date: Apr. 2, 1999

§ 102(e) Date: Apr. 2, 1999

[87] PCT Pub. No.: WO98/14745

PCT Pub. Date: Apr. 9, 1998

[30] Foreign Application Priority Data

Oct. 2, 1996 [DE] Germany ..... 196 42 080

[51] Int. Cl.[7] ..... F41A 33/00

[52] U.S. Cl. ..... 434/11; 434/13; 434/21

[58] Field of Search ..... 434/11, 16, 18, 434/19, 21; 42/1

[56] References Cited

U.S. PATENT DOCUMENTS

| | | | |
|---|---|---|---|
| 4,302,190 | 11/1981 | Shaw et al. . | |
| 4,352,665 | 10/1982 | Kimble et al. . | |
| 4,380,437 | 4/1983 | Yarborough, Jr. | 434/18 |
| 4,480,999 | 11/1984 | Witherell et al. | 434/18 |
| 4,619,616 | 10/1986 | Clarke | 434/11 |
| 5,488,795 | 2/1996 | Sweat . | |
| 5,947,738 | 9/1999 | Muehle et al. | 434/16 |

FOREIGN PATENT DOCUMENTS

| | | |
|---|---|---|
| 0 262 543 | 4/1988 | European Pat. Off. . |
| 2 345 694 | 10/1977 | France . |

OTHER PUBLICATIONS

Patent Abstracts of Japan vol. 95, No. 10, Nov. 30, 1995 & JP 07 174493 A (ASIA OPT KK), Jul. 14, 1995, see abstract; figure.

*Primary Examiner*—Sam Rimell
*Attorney, Agent, or Firm*—Nixon & Vanderhye

[57] ABSTRACT

The present invention relates to a laser pistol characterized in that the laser (1) is inserted into the barrel and electronically triggered (13). In order to have a true shooting sensation, a compressed air cylinder (28) causes the pistol carriage to recoil. The cylinder (28) is controlled by a changeover valve (24') which is actuated by a control element coupled with the trigger (9). When working, the changeover valve (24') causes a compressed air loader (17') to connect with the cylinder (28).

9 Claims, 3 Drawing Sheets

LASER PISTOL

BACKGROUND OF THE INVENTION

A training system for firearms training of police officers and other security personnel is already ready known under the name "DIKROSEC PCS", which offers each firearms trainee, from novices to members of a commando unit, the maximum level of learning efficiency. The training system works both with laser weapons and with handguns and automatic pistols in true firing situations. It functions with an optical locking system which does not require an expensive screen but merely a piece of target wallpaper attached to a wooden frame.

Although this system constitutes a kind of shooting cinema, the marksman's shots do not lead to the stopping of the film, as was customary up to now, but to a life-like reaction. If the shot hits the assailant in the film, he then falls down. If he misses his target, then the assailant runs for cover and later renews his fire on the marksman.

In order to take the level of knowledge of the firearms trainee into account, the system offers different variants which can be called up on the control computer by selection number before training. Thus, the novice can combat the assailant using single shots, whilst the advanced trainee can choose to fire left and right, or also the burst of fire from the automatic pistol. It is also possible to allow two perpetrators to attack at the same time.

In addition, the permissible hits field can be selected, depending on the level of knowledge of the trainee. Whereas, at the beginning of the training, each body hit can be rated as a success, for advanced trainees, only a shot in the region of the vital areas, and, for members of a commando unit, only a hit into the FBI silhouette is rated as a success. The result of the firearms training can be issued directly on a print-out or stored in the system.

Whereas with the conventional shooting cinema, it is known by the second time at the latest on which side the perpetrator in the film appears, with the "Easy-Film" film system, a film located in the memory is triggered in different variants by a random generator so that the perpetrator can appear from any corner or also suddenly in the middle of the screen. It is thus impossible for the marksman to focus on one expected position. Together with life-like sound effects and an accompanying wide-screen system, the DIKROSEC PCS training system ensures training which allows the firearms trainee to also be able to defend himself in a real-life situation with the prospect of success.

A counter-shot camera available as an accessory, which shows the marksman when firing on the perpetrator, enables the firearms trainee and his instructor to examine questions of firing behaviour and cover immediately after each round.

If laser weapons are used with the known system, no ventilation systems, screen, butt, noise protection or munitions need be used if the aim is merely to familiarize novices with handling regulations, or practice clean trigger-pulling by aiming. Such training can be carried out in any room whatever as long as it is provided with an interactive evaluation system. To do this, a light-sensitive mask is required which is examined after the shot in order to ascertain at what spots the point of light was situated. The stored hits pattern is then compared with a hit mask and the result transferred as a signal to a projection unit.

From U.S. Pat. No. 4,380,437, a laser beam weapon is furthermore known which is connected to a source of compressed air via a hose-pipe to push back the carriage.

This concept cannot be realized as a pistol, as the hose pipe connection would completely destroy a true-to-life sensation; such a pistol would also not be able to be worn in a pistol holder on the body.

A disadvantage of the known laser weapons, however, is that they do not give a true firing sensation as, when the trigger is actuated, there is merely an electronic triggering of the laser and thus the creation of a laser beam, whereas the recoil generated in the case of a real shot by the driving back of the carriage and the discharge of the cartridge case is missing.

Finally, from FR-A-2 685 072, a pistol with a compressed-air cartridge for pushing back the carriage is known which, incidentally, does not emit a laser beam. The compressed-air cartridge is loaded as with a soda water bottle and thus does not at all resemble the loading of a pistol magazine so that here again, there is a clear difference from real conditions.

SUMMARY OF THE INVENTION

The object of the invention is to develop a laser pistol of the type named at the beginning so that the marksman is given a true firing sensation when the weapon is fired.

The features of patent claim 1 serve to achieve this object.

The invention thus relates to a laser pistol for simulating pistol shots with a pistol grip; a barrel mounted on the pistol grip; a carriage which is borne by the pistol grip and is moveable along the barrel; a trigger with a trigger guard which are attached to the pistol grip and the barrel; a hammer to cock the trigger and actuate the pistol; and a magazine which can be inserted from below into the pistol grip; characterized in that a laser is inserted into the barrel which sends out a target laser beam from the barrel muzzle when the trigger is pulled; that an electronics control system is arranged in the pistol and is coupled with the laser and the trigger; that a battery is housed in the pistol grip and is connected to the electronics control system; that a valve block is mounted in the pistol grip and contains a changeover valve; that the changeover valve can be activated by the trigger; that a compressed-air cylinder is arranged in the carriage and rests with the free end of its piston rod against the carriage and moves this rearwards in the direction of the hammer when impinged upon by compressed air; that the compressed-air cylinder has a piston which forms a compressed-air chamber on its side facing away from the piston rod; that the compressed-air chamber is in flow electrical connection with the changeover valve; that the valve block has a connector for a compressed-air magazine; and that the compressed-air magazine can be inserted into the pistol grip.

In another version of the invention, the compressed-air magazine and the changeover valve form a unit.

It is pointed out that the invention is not restricted to laser pistols, but extends generally to all kinds of laser weapons which are to simulate a hand-held weapon, thus for example to rifles or automatic pistols, and that another suitable compressed gas can also be used instead of compressed air.

DESCRIPTION OF THE FIGURES

The invention is explained in more detail in the following using embodiments; there are shown in.

DETAILED DESCRIPTION OF A PREFERRED EMBODIMENT

In the two Figures, identical parts are given identical reference numbers.

Figure 1:
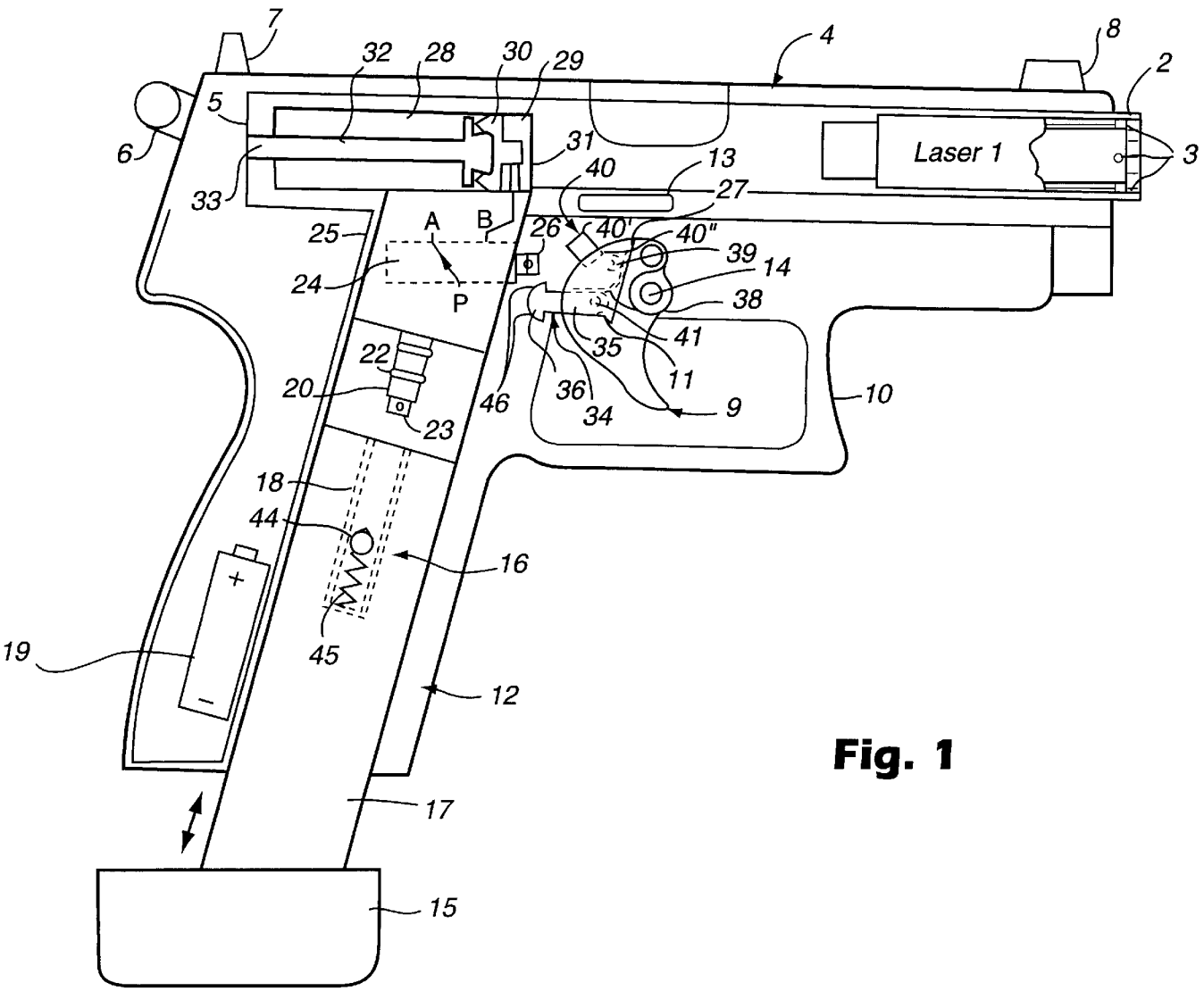
FIG. 1 is a schematic side elevational view of a laser pistol according to a first embodiment of the present invention.

FIG. 1 shows a laser pistol in schematic representation with a pistol grip 12 which bears a barrel 2 in known manner, which are covered by a carriage 4. A trigger 9 is fixed swivellably in the conventional way at a fulcrum 14 in the body of the laser pistol, and is protected by a trigger guard 10. A compressed-air magazine 17 according to the invention can be inserted from below into the pistol grip 12. A laser 1 is inserted into the barrel 2 of the laser pistol, whose laser axis can be aligned with the axis of the pistol barrel by four adjustment screws 3 arranged at the periphery. A rearsight 7 is arranged at the rear end of the carriage 4 on the carriage 4 in per se known manner, whilst a foresight 8 for aiming known per se is provided on the front end of the carriage 4.

As with a real pistol, the laser pistol according to the invention has a hammer 6 arranged on the rear end, which can be cocked by hand or by pulling back the carriage 4. Another possible way of cocking the hammer 6 is to pull the trigger 9 through powerfully. The latter is not favoured, however, as the shot usually jerks. With a real pistol, the cocked hammer 6 is released by actuating the trigger 9 in order to strike a firing pin which is thereby driven quickly and with force into a percussion cap of a cartridge located in the barrel. With the laser pistol according to the invention, this striking mechanism is missing for the most part, and instead of a firing pin, a compressed-air cylinder 28 is provided in the inside of carriage, which has a piston 30 and a piston rod 32 connected to the piston. The free end 33 of the piston rod 32 projects outwards through the wall of the compressed-air cylinder 28 and rests against a rear wall 5 of the carriage 4. The other side of the piston 30 forms with the remaining part of the compressed-air cylinder 28 a compressed-air chamber 29, which has a flow connection with a valve block 25 via a channel 31. The piston 30 is provided with seals known per se on its periphery, in order to form an air-tight compressed-air chamber 29 when the channel 31 is closed.

A changeover valve 24 is arranged in the valve block 25. The changeover valve 24 has three connection apertures A, B and P and a valve tappet 26 which, in per se known manner, creates a flow path from P to A in a first position, and from P to B in a second position. According to the invention, the channel 31 creating the connection to the compressed-air chamber 29 is connected to the connection B of the changeover valve 24, whilst a connector 20 arranged on the underside of the valve block 25 forms a flow channel to the connection P of the changeover valve 24.

The connector 20 projects downwards in the inside of the pistol grip 12 and is provided on its periphery with two O-rings 22 placed at a distance from each other, which are to seal off the wall of a connection bore 18 provided in the compressed-air magazine.

When the compressed-air magazine is completely inserted into the pistol grip 12 lying in this position with its magazine foot 15 against the lower edge 21 of the pistol grip 12 and being lockable in per se known manner, not shown, vis-à-vis the pistol grip 12, the free lower end 23 of the connector 20 presses the ball 44 of the non-return valve 16 against the action of a compression spring 45 inwards into the inside of the compressed-air magazine 17, whereby the ball 44 is lifted from its associated valve seat and releases a flow of compressed air from the inside of the compressed-air magazine 17 to the connection P of the changeover valve 24.

A T-shaped or hammer-like actuator 34 coupled with the trigger 9 serves to actuate the valve tappet 26, and thus to switch to the flow path P-B by the changeover valve 24. The actuator 34 is mounted roughly lying in a recess of the trigger 9, in such a way that the stem 35 of the actuator 34 is articulated with its free end to the securing point 41 and lies on an essentially horizontal shoulder 11 of the trigger 9. The shoulder 11 prevents a movement of the actuator 34 downwards so that the actuator 34 cannot be swivelled anti-clockwise around the securing point 41 when considered according to the drawing. However, it is possible to swivel the actuator 34 clockwise, as only a leaf spring 38 presses on the upper side of the stem 35 of the actuator 34. Thus, only the elastic force of the leaf spring 38 must be overcome to lift the actuator 34 from the shoulder 11 of the trigger 9 and to swivel it up clockwise.

The leaf spring 38 is attached with one end to an essentially vertical shoulder 27 by a screw 39. The vertical shoulder 27 and the horizontal shoulder 11 form an angle of roughly 100° C. in one version.

The head 36 of the actuator 34 is hammer-like and has rounded edges 46 which touch the valve tappet 26 when the trigger 9 is actuated, and press this into the housing changeover valve 24 to switch from AP to BP.

The trigger 9 is furthermore provided with an electric contact 40 which is brought roughly into the 10 o' clock position via the actuator 34 in the version portrayed. The contact 40 is a normally closed contact with a first contact element 40' which is attached to the pistol body, and a second contact element 40" which sits on the trigger 9. This kind of contact elements 40' and 40" is known per se. The electric contact 40 serves to start the electronics control system 13, arranged in the carriage housing normally over the trigger, which activates the laser 1 when the contact elements 40' and 40" are opened in order to send a laser beam out of the pistol barrel 2 in the target direction.

In another version of the invention, not shown, a pneumatic/electric converter is provided at the changeover valve 24 instead of the contact 40, which, when the valve tappet 26 is actuated, delivers an electric signal to the electronics control system 13 to generate a laser impulse through the laser 1. Such P/E converters are known to the person skilled in the art. They have the advantage that fitting is simpler than with the contact elements 40' and 40".

The electronics control system 13 is supplied in per se known manner by a battery 19 which is housed likewise in known manner in the pistol grip 12. Details of the electric connection of battery 19, electronics control system 13, contact 40 and laser 1 are omitted for reasons of clarity, as they are known in any case to the person skilled in the art.

A compressed-air magazine 17, filled with compressed air by a compressed-air source, not shown, is inserted from below into the pistol grip 12 in the manner shown in the drawing and locked to the laser pistol. The connector 20 penetrates the connection bore 18 of the compressed-air magazine 17 and opens the non-return valve 16. When the trigger 9 is not yet actuated, compressed air is thus available up to connection P of the changeover valve 24.

To fire, the trigger 9 is pulled by the index finger of a marksman in per se known manner in the direction of pistol grip 12 and the actuator 34 swivelled upward clockwise.

Upon this swivel movement, on the one hand, the contacts 40' and 40" are opened and a laser impulse triggered, and on the other hand, the head 36 of the actuator 34 resting against the horizontal shoulder 11 of the trigger 9 presses the valve tappet 26 into the changeover valve 24 so that a flow path is formed from the connection P via the connection B to the compressed-air chamber 29 of the compressed-air cylinder 28. The compressed air quickly flowing in drives the piston 30 in the drawing to the left whereby the piston rod 32 connected to the piston 30 drives the carriage 4 rearwards as with a real shot; at the same time, the hammer 6 is cocked. An extremely true-to-life firing sensation thereby arises.

Figure 2:
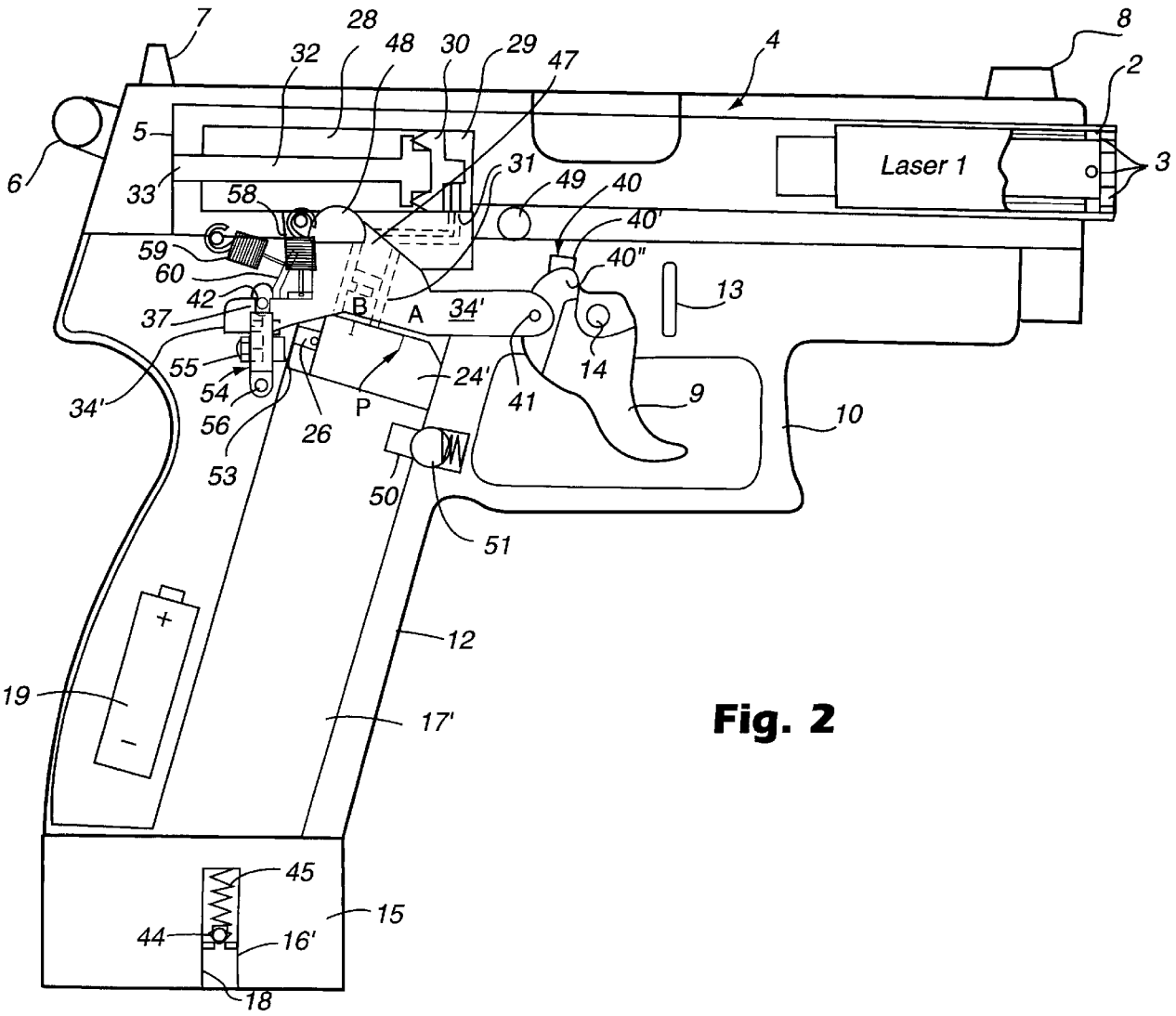
FIG. 2 is a view similar to FIG. 1 illustrating a second embodiment thereof.
Figure 3:
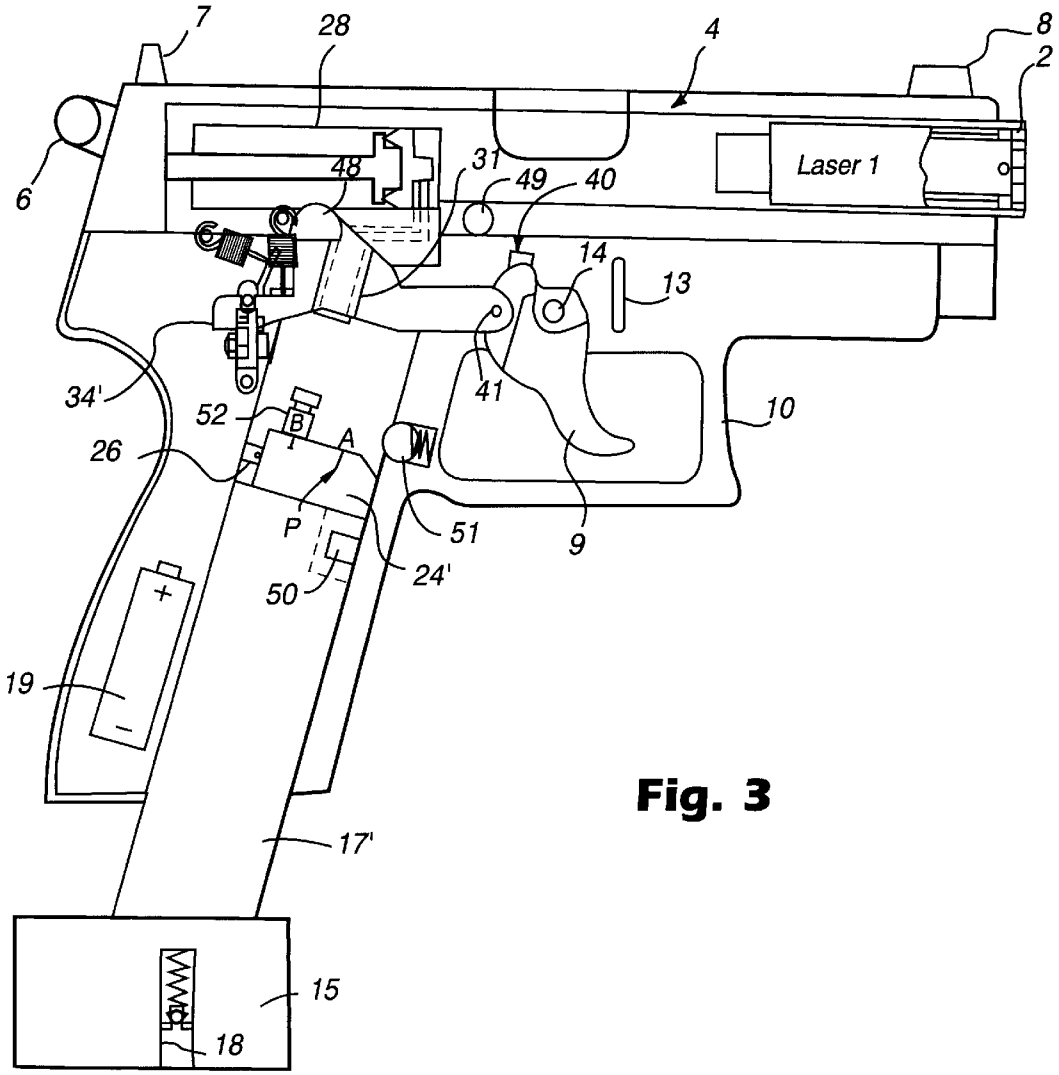
FIG. 3 is a view similar to FIG. 2 illustrating the insertion of a compressed-air magazine into the pistol handle.

FIGS. 2 and 3 show another version of the invention in which the compressed-air magazine 17' forms with the changeover valve 24' a unit which is firmly connected to each other. The changeover valve 24' sits above on the compressed-air magazine 17' which is equipped for this reason at its lower end with the non-return valve 16' so that the compressed-air magazine 17' is filled from below via the non-return valve 16'. In other words, the non-return valve 16' is arranged in the magazine foot 15. A recess 50 is provided in the vicinity of the upper end of the compressed-air magazine 17' into which a spring-loaded ball 51 locks when the compressed-air magazine 17' is completely pushed into the pistol grip 12. The valve tappet 26 of the changeover valve 24' is directed rearwards, thus directed away from the trigger 9 in the second version. The valve tappet 26 is actuated by a catch 53 which is adjustably secured to the front of a U-shaped slotted block 54 with the help of a regulating screw 55. The U-shaped block is rotatably housed at its lower end on the pistol grip 12 via a journal 56, whereby the catch 53 can be swivelled against the valve tappet 26 to press this into the changeover valve 24' and thus carry out a switch from P_A to P_B. This switch allows the compressed air to flow out of the compressed-air magazine 17' via the channel 31 into the compressed-air cylinder 28 and drives the piston 30 in FIG. 2 to the left, whereby the carriage 4 is moved rearwards.

The journal 56 of the U-shaped block 54 is arranged in the pistol perpendicular to the plane of the drawing, whereby the free end of the actuator 34' can protrude from above between the two legs of the block 54. The free end of the actuator 34' has an incision 37 in the vicinity of its end, which hooks under a pin 42. The pin 42 connects the two legs of the U-shaped block 54.

The other end of the actuator 34' is swivellably attached to the trigger 9 via the securing point 41. The trigger 9 is fixed swivellably at the fulcrum 14 as in the first version according to FIG. 1, and provided with an electric contact 40. By opening the contact elements 40' and 40", the electronics control system 13 is started and thus the laser 1 activated in order to send a laser beam out of the barrel 2 of the pistol in the target direction. The contact 40 and the electronics control system 13 are only portrayed schematically; the person skilled in the art knows how they are to be connected together and switched such that the laser 1 can be activated upon opening of the contact 40.

The actuator 34' is an elongated lever made of steel with a thickness of roughly 1 mm and an upwardly directed continuation 47 to whose apex a semicircular-shaped disk 48 roughly 33 mm thick is secured. The disk 48 projects into the path of the carriage 4 so that it is pressed downwards by a roughly 2 mm thick circular-shaped second disk 49 when the carriage 4 is drawn back. The second disk 49 is attached to the carriage 4, the attachment point being able to be specified by the plant according to the desired stroke.

Furthermore, a first tension spring 58, which is suspended by one end from the pistol grip 12 and by its other end from the actuator 34' , engages in the vicinity of the free end of the actuator 34'. The first tension spring 58 thereby always pulls the actuator 34' upwards so that the incision 37 always rests against the pin 42 of the block 54.

A second tension spring 59 is also attached with one end to the pistol grip 12, whereas its other end covers a finger 60 attached in front to the U-shaped block 55 and thereby always pulls the U-shaped block 54 rearwards, thus away from the valve tappet 26.

Thus, if the trigger 9 is actuated, this swivels about the fulcrum 14 and pulls the actuator 34' upwards and thus shifts it somewhat to the right so that the end of the actuator 34' provided with the incision 37 swivels the U-shaped block 54 clockwise around the journal 56 in the representation according to FIG. 2, and thereby presses the catch 53 against the valve tappet 26. The swivel movement of the block 54 thus takes place against the action of the second tension spring 59. During this movement, the two contact elements 40' and 40" are opened at the same time and the electronics control system 13, which activates the laser 1, triggered.

At the same time, by actuating the valve tappet 26, the changeover valve 24' is switched so that a flow connection is created from the compressed-air magazine 17' to the compressed-air chamber 29 of the compressed-air cylinder 28. The compressed air flowing into the compressed-air chamber 29 drives the piston 30 to the left and thereby also moves the carriage 4 to the left, whereby the second disk 49 moves in the direction of the first semicircular disk 49 attached to the apex of the actuator 34'. As soon as the second disk 49 touches the first disk 48, it presses the actuator 34' in the drawing to the left and downwards, whereby on the one hand, the trigger 9 is swivelled around the fulcrum 14 anti-clockwise into the starting position and, on the other hand, the catch 53 detaches itself from the valve tappet 26. The changeover valve 24 thereby switches back into its starting position in which the compressed-air connection via the channel 31 to the compressed-air chamber 29 is prevented.

FIG. 3 shows the second embodiment in the situation when the compressed-air magazine 17' is inserted. It will be seen that the compressed-air magazine 17' and the changeover valve 24' form a unit which are jointly inserted into the pistol grip 12 from below. A connection 52 directed at the changeover valve 24' in the inserted direction of the compressed-air magazine 17' , which engages in the channel 31 and seals it when the magazine is completely inserted, can furthermore be particularly clearly recognized in this Figure. For this, an O-ring which is not shown in the drawing sits expediently at the free end of the connection 52.

It is pointed out that the laser pistol according to the invention is particularly suitable for training marksmen because, as with a real pistol, a magazine 17 or 17' is inserted into the pistol grip 12, having approximately the same shape and same weight as a cartridge magazine. The whole handling therefore extraordinarily well resembles the handling of a real pistol, so that extremely realistic firearms training can be carried out with the laser pistol according to the invention.

What is claimed is:

1. A laser pistol for simulating a pistol shot comprising:

a pistol grip having a magazine receiving chamber open at a lower end of the grip;

a barrel mounted on the pistol grip;

a carriage carried by the pistol grip and movable along the barrel;

a trigger and a trigger guard carried by the pistol grip and the barrel;

a hammer for cocking the trigger and actuating the pistol;

a compressed gas magazine receivable within the chamber of the pistol grip through the open lower end of said chamber;

a laser in the barrel for projecting a laser beam from the barrel when the trigger is actuated;

an electronics control system disposed in the pistol and coupled with the laser and the trigger;

a battery housed in the pistol grip and connected to the electronics control system;

a valve block carried by the pistol grip and having a changeover valve coupled to said trigger for actuation by said trigger;

a compressed gas cylinder having a piston rod carried by the carriage, a free end of said piston rod bearing against said carriage for moving the carriage rearwardly in the direction of the hammer when driven by compressed gas from said compressed gas cylinder;

said compressed gas cylinder having a piston forming a compressed gas chamber on a forward side of said cylinder away from the piston rod;

said compressed gas chamber being in flow communication with the changeover valve;

said valve block having a connector for communicating with said compressed gas magazine.

2. A laser pistol according to claim 1 wherein the compressed gas magazine has a non-return valve in sealing engagement with the connector of the valve block when the compressed gas magazine is completely inserted into the pistol grip chamber and provides a flow path from the compressed gas magazine to said changeover valve.

3. A laser pistol for simulating a pistol shot comprising:

a pistol grip having a magazine receiving chamber open at the lower end of the grip;

a barrel mounted on the pistol grip;

a carriage carried by the pistol grip and movable along the barrel;

a trigger and a trigger guard carried by the pistol grip and the barrel;

a hammer for cocking the trigger and actuating the pistol;

a compressed gas magazine receivable within the chamber of the pistol grip through the lower open end of the chamber;

a laser in the barrel for projecting a laser beam from the barrel when the trigger is actuated;

an electronics control system disposed in the pistol and coupled with the laser and the trigger;

a battery housed in the pistol grip and connected to the electronic control system;

a compressed gas cylinder having a piston rod carried by the carriage, a free end of said piston rod bearing against said carriage for moving the carriage rearwardly in the direction of the hammer and driven by compressed gas from said compressed gas cylinder;

a compressed gas magazine receivable in the chamber in the pistol grip, said pistol grip having an integrated changeover valve at its upper end and a connection bore at an opposite end thereof for connection with said magazine, a non-return valve in said connection bore;

said changeover valve being actuatable by the trigger;

said compressed air cylinder having a piston forming a compressed air chamber on a side of said piston away from the piston rod, and a channel providing flow communication between said changeover valve and said compressed gas chamber.

4. A laser pistol according to claim 3 wherein the changeover valve has a valve tappet, an actuator coupled to the trigger for actuating said valve tappet, said actuator in a first position interrupting the supply of compressed gas from the compressed gas magazine to the compressed gas cylinder and, in a second position, releasing the compressed gas for flow to said compressed gas chamber.

5. A laser pistol according to claim 4 wherein the actuator comprises a generally T-shaped piece with a stem and a head, said actuator being articulated to the trigger and lying on a horizontal shoulder of the trigger, said actuator being pivotal upwardly against the action of a spring, said head having rounded edges engageable with said tappet upon pivoting upwardly and bypassing said tappet upon pivoting downwardly.

6. A laser pistol according to claim 4 wherein the actuator comprises a triangular-shaped piece suspended at one end from a U-shaped block, an opposite end of said piece being articulated to said trigger, said piece carrying at an apex thereof a first disk, and an element carried by said carriage for engaging said disk when the cartridge is disposed rearwardly to displace the disk downwardly.

7. A laser pistol according to claim 1 wherein the trigger has a contact which, when the trigger is actuated, activates the electronics control system to trigger the laser and project the laser beam.

8. A laser pistol according to claim 7 wherein the contact has two normally closed contact elements.

9. A laser pistol according to claim 4 wherein the changeover valve includes a pneumatic/electric converter which, when the valve tappet is actuated by the trigger, triggers the electronics control system to actuate the laser.

* * * * *